United States Patent [19]

Fleissner

[11] 4,070,877

[45] Jan. 31, 1978

[54] APPARATUS FOR THE CONTINUOUS STEAMING OF TEXTILE MATERIAL OF MAN-MADE FIBER MATERIAL

[75] Inventor: Hans Fleissner, Riehen, Switzerland

[73] Assignee: Vepa Aktiengesellschaft, Switzerland

[21] Appl. No.: 626,539

[22] Filed: Oct. 28, 1975

Related U.S. Application Data

[62] Division of Ser. No. 439,049, Feb. 4, 1974, Pat. No. 3,949,577.

[30] Foreign Application Priority Data

| | | |
|---|---|---|
| Feb. 2, 1973 | Germany | 2305155 |
| Feb. 2, 1973 | Germany | 2305154 |
| Mar. 1, 1973 | Germany | 2310195 |
| June 9, 1973 | Germany | 2329687 |

[51] Int. Cl.[2] ..... D06B 3/02

[52] U.S. Cl. ..... 68/5 D

[58] Field of Search ..... 68/5 D, 5 E; 8/149.3; 134/105; 34/155, 157, 158, 159

[56] References Cited

U.S. PATENT DOCUMENTS

| | | | |
|---|---|---|---|
| 2,638,765 | 5/1953 | Quinn | 68/5 D |
| 3,585,696 | 6/1971 | Aronoff | 68/5 D X |
| 3,838,968 | 10/1974 | Fleissner | 68/5 D X |

FOREIGN PATENT DOCUMENTS

| | | | |
|---|---|---|---|
| 1,026,271 | 3/1958 | Germany | 68/5 D |

*Primary Examiner*—Philip R. Coe
*Attorney, Agent, or Firm*—Craig & Antonelli

[57] ABSTRACT

An apparatus for the continuous steaming of natural and/or synthetic material including textile material or man-made fiber material, e.g. staple fibers, endless material and also synthetic fibers, webs, bonds, yarns and the like, comprising at least one housing shaped similarly to a bell, i.e. a housing formed into a chamber closed all around and open in the downward direction toward a mounting surface, steam producing means and/or steam feeding means being provided in the zone of the sidewalls within said housing; and at least one conveying means for the fibrous material which extends from below into the housing and extends out of the housing again at the bottom thereof.

3 Claims, 6 Drawing Figures

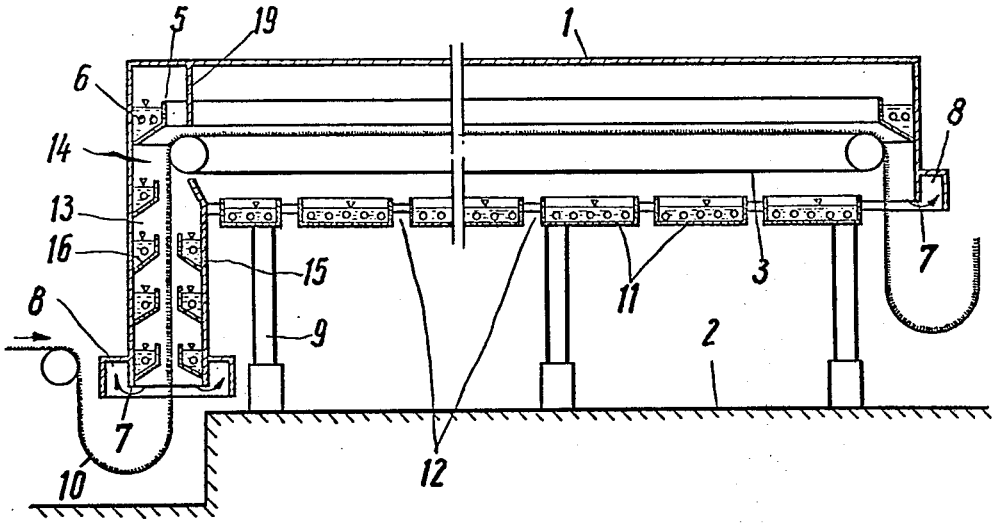
Fig. 3
Fig. 4
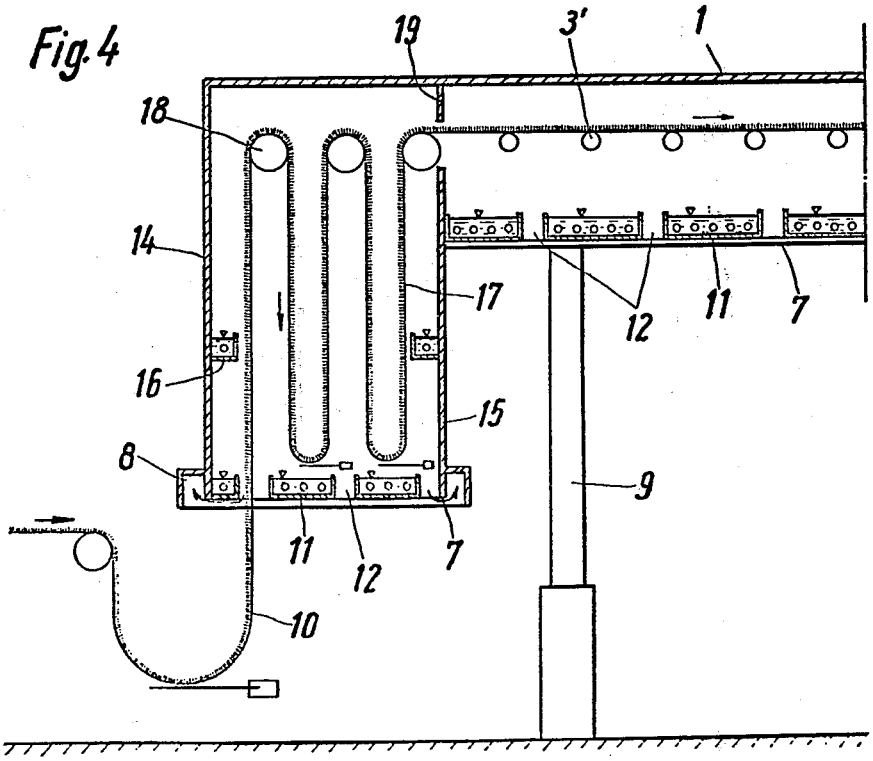

APPARATUS FOR THE CONTINUOUS STEAMING OF TEXTILE MATERIAL OF MAN-MADE FIBER MATERIAL

This is a division of application Ser. No. 439,049 filed Feb. 4, 1974, and now U.S. Pat. No. 3,949,577.

This invention relates to an apparatus for the continuous steaming of synthetic and/or natural textile material or man-made fiber material, such as endless material, e.g. sheets, webs, bands, etc., as well as cut man-made fibers, e.g. staple fibers.

The objective is to find a universal steamer which is absolutely free of air even during opertion, and remains free of air, and which is economical during use.

The problem of finding such a steamer has been solved by providing a steamer housing having a shape similar to a bell; in other words, the housing consists of a hood which is closed on all sides and open in downward direction toward its mounting surface, wherein steam generating and/or steam feeding means are arranged in the zone of the sidewalls and wherein at least one conveying means for the material extends from below into the housing and again out of the housing.

The advantage of an apparatus of this type resides in the possibility of producing, with a minimum steam consumption, an absolutely air-free and quite steam atmosphere within the steamer hood which is limited at the bottom by steam absorbing devices, and in being able to maintain such atmosphere. This result is based on the fact that air has a higher specific gravity than steam. Consequently, the air present in the hood automatically falls downwardly. This also holds true if, after establishing a steam atmosphere within the hood, air is entrained into the device during its operation together with the material entering the steam atmosphere. The air immediately drops out of the material and is replaced by steam entering the material. Such an apparatus is of advantage not only in the steaming of synthetic fiber material, for example, during the shrinking of the fibers, but also is suitable for the fixation of dyes to any type of textile material in a saturated steam atmosphere.

All machines wherein a high temperature is produced for treatment purposes have the disadvantage that this high temperature is troublesome in case of any repairs which may become necessary within the hot atmosphere. It is customary to provide doors in the walls of the housing, providing access to the interior. However, it is unavoidable in such apparatus to cool the interior prior to repair, since otherwise it is impossible for one to enter the treatment chamber.

The basic construction of a steamer of the type mentioned above is to be improved by a possibility for making the treatment chamber — i.e., also the conveyor device — accessible for a possibly required repair service or the like, without destroying the steam atmosphere.

This possibility is provided by arranging the steamer hood to be movable with respect to a fixed conveyor means or vice versa. For example, the steamer hood could be set up on a base from which it can be lifted hydraulically or pneumatically, preferably out of the zone of the conveying means; suitable for this purpose are, for example, pistons which can be extended telescopically.

The advantage of this supplementary measure is great. In the future, no time and no energy need be wasted any longer in a machine of the above-described type, in order to be able to do any kind of work on the material already fed into the steamer, on the conveyor, or on any other parts of the machine. The steamer hood need merely be lifted, whereby the steam atmosphere is still preserved within the hood, but moves upwardly together with the hood. Of course, the hood can also be arranged in a fixed position and the conveyor can be fashioned to be movable outside of the hood. In this connection, a decision must first be made in each case which construction would be the more practical one.

Once the work on the parts thus made accessible underneath the steam level has been finished, the hood need merely be lowered again in order to place the steamer in operation, and a complete steam atmosphere is immediately restored around the textile material. The steaming operation can be continued without an impairment of the normal operating speed. The measure of the present invention is, for example, also of great advantage when placing the apparatus on stream, or when changing a dye. In any event, the operations on the conveyor, for example for the initial introduction of the textile material or for cleaning the conveyor belt, can be executed while the steam atmosphere is being built up in the steamer hood.

The steamer of the present invention is also suitable, in particular, for the fixation of dyestuffs in printed lengths of material, such as carpets. Especially in this case, it is important to provide a pure steam atmosphere during the treatment of the face side of the length of material in order to flawlessly set the printing pastes, because otherwise, in spite of the horizontally guided material, color shifts can occur in the printed pattern in the festoon steamer which may be connected after the steamer device. Therefore, an advantageous feature for such a horizontal steamer is to fashion the steamer housing as a downwardly open hood wherein preferably the steam atmosphere is produced by a water sump present in channels attached to the housing walls, which channels are open at the top and are traversed by heating pipes.

As mentioned above, the greatest problem in the fixation of printed materials, such as carpets, is the prevention of a color shift, for example into the light-colored ground shade. Such a running of the printing dye occurs chiefly if the web of material is under the effect of condensing steam when entering the steamer. Since the feeding should take place from below into the steamer, the material can only be positioned more or less vertically in this phase of operation. These two conditions can be combined in the steamer of the present invention, in accordance with the basic aspect thereof, if the lower rim of the steamer hood, and thus the steam level, is located below the horizontally extending loaded face of the conveyor, optionally also only shortly below the layer of the material to be subjected to the steam treatment. An exact steam level can readily be produced in the above-described apparatus, especially if steam exhausting devices are arranged around the lower rim of the hood.

The steam atmosphere is produced, in the aforedescribed apparatus, by a water vapor present in channels open at the top, mounted on the hood wall. This type of steam generation may be insufficient especially for wide lengths of material and for steamer types of a great length.

Consequently, the invention intends to provide furthermore a steamer, especially a horizontal steamer, wherein with any size a fully satisfactory saturated steam atmosphere can be produced and maintained, by an arrangement such that the air entrained by the material can be discharged downwardly without impediment over the length of the steamer, but especially in the zone of the inlet for the textile material.

Such a steamer is provided if the saturated steam generation means consists of a conventional water sump arranged beneath the conveyor means and covering the hood in the downward direction, which sump extends only partially across the width and length of the base area of the hood and thus forms zones, such as air passage slots, ducts, holes, or the like, where the hood is open in the downward direction. The water sump, which generates a complete steam atmosphere in the steamer chamber has the disadvantage that it covers the steamer bottom totally and thus does not readily permit the downward discharge of any air contained in the steamer chamber. By means of the feature of the present invention, a sufficient saturated steam generation is ensured over the large base area of, for example, a horizontal steamer, without it being possible for air to collect in the steaming chamber.

Since a substantial portion of the air impairing the steaming operation is entrained into the steaming chamber together with the textile or fibrous material, it is advisable to provide air passage zones particularly in the area of the material inlet in the containers forming the water sump; one of the slots or the like left vacant by the water sump containers constituting an inlet for the material.

The horizontal steamer is preferably utilized as the steaming unit, because there are no problems in the conveyance of the material with such a steamer. The disadvantage inherent in such steamer is, apart from its great length, that the air entrained with the material to be treated continues to rest on the material in case of materials of low air permeability or in case of materials covered with a thick layer of dye paste; this is so, because the air cannot drop down through the dense material automatically due to its higher gravity. Although the design of the water sump in accordance with the invention offers the possibility of freeing the steamer chamber from air, a complete fixation effect cannot be expected in spite thereof, because the layer of air on top of the material to be treated prevents a contact of the dyed fibers with the steam.

This problem can be solved, in a further embodiment of the basic construction of this invention, by extending the inlet slot for the material in the downward direction for the formation of a material inlet zone which is open toward the bottom, optionally a material inlet duct, wherein saturated steam generation means are disposed. Consequently, the material to be treated with steam is drawn through a rather long, vertically extending inlet zone where the entrained air can readily be detached or removed from the material and can be discharged from the steaming chamber in the downward direction. In a subsequent horizontal section, any additional air which has not adhered to the surface of the material can still drop downunimpeded. This horizontal section can advantageously also be fashioned as a deck-type steamer, the outlet of which is provided in the bottom of the associated moving-loop steamer section.

Such a rather long, vertical inlet zone is disadvantageous for some color-printed material, because steam will condense on the material which is fed in the cold condition and can run, together with the imprinted dyestuff, into the adjacent, perhaps white, pile. In order to prevent this from happening, the invention provides, in another embodiment, to separate the inlet duct with respect to the remaining portion of the steamer, by a wall so that the inlet can optionally be functionally separated from the remaining region of the steamer. Thus, the steamer can be operated as desired in dependence on the character of the textile material or of the dye to be fixed.

In connection with other materials, in turn, especially dyed material, a horizontal steamer causes the problem of an incomplete fixation of the dye in the zone of the outermost fiber tips. A so-called grey veil is produced due to a downward pooling of the dye when the material is traveling horizontally. In order to equip the steamer of the present invention also for this range of application, the invention provides, in an advantageous embodiment, to dispose two or more guide rolls in the zone of the material inlet at the steamer ceiing, for the conveyance of traveling loops having a certain length, followed by a horizontal steamer. If, in the zone of these traveling loops, the dye is prefixed on the entire fiber, a sinking of the dyestuffs along the fibers need no longer be feared in the zone of the horizontal section. Also, in this type of steamer, the housing in total consists of a hood which is open in the downward direction and is partially covered by a water sump, leaving air passage zones vacant in this area.

As indicated above, the advantages of a horizontal steamer reside in that the material can be conducted therethrough without any problems. Besides, the steamer is suitable, in particular, for those materials, the pile side of which, in the steamed condition, must not come into contact with conveying elements, since otherwise a permanent alteration of the pole cannot be avoided. However, the disadvantage of this type of steamer resides in the necessity for using a rather large amount of auxiliary means, in order to reintroduce the liquor which sinks downwardly due to the force of gravity again to the tips of the pile by frothing agents applied thereto. Otherwise, the tips of the pile would be depleted in dyestuffs, which causes the feared formation of a frosting. The use of larger amounts of auxiliary means makes the treatment process more expensive. This can be avoided by the use of a different type of steamer, such as, for example, a festoon steamer; however, the guidance of the traveling material cannot be controlled as simply in such a device.

Consequently, another purpose of the present invention is to provide features, especially in conjunction with a horizontal steamer, which avoid the use of additional auxiliary means and yet result in a 100% complete dyeing of the pile of the material.

This object is attained by providing that the pile face of the material points in the direction of the conveying elements, i.e. downwardly, at least at the beginning of the steaming process. Thus, the dye poured onto the pile prior to the steaming step can no longer sink down to the root of the pile, but rather is fixed immediately at the beginning of the steaming process especially at the pile tips. Of course, such a conveyance of the material is possible only in case of those carpets, the pile of which withstands a pressure stress in the steamer. In case a multiple-deck steamer is provided, the material is guided in the second deck in opposition (i.e., in an opposite manner) to the guidance effected in the first deck, so that the pile points upwardly in the second deck. However, at this point, the conveyance of the material in this way is no longer of disadvantage for the fixation process of the pile tips, since a sufficient amount of dye has already been fixed at that location in the first portion of the steaming process, so that a frosting effect can no longer occur.

Apart from the fact that the conveyance of the material as proposed by the present invention is being utilized only, for example, in case of polyamide carpets, where a pile deformation is not deleterious and where, on the contrary, the milling action during contact with the conveying elements is sometimes even desirable, this type of procedure is, of course, possible only if the face side of the carpet is dyed a solid color, i.e. no printing was carried out. In case of printed carpets, the face side must remain out of contact with any conveying elements in order to avoid blotching of the color. In order to be able to employ a steamer of the aforementioned type in spite of the above consideration, according to this invention, it is suggested to dispose, in a continuous plant, the printing device upstream of the steamer, while a dye applicator operating according to the infusion principle is arranged underneath the steamer with a conveying direction in opposition to the traveling direction of the material beyond the steamer inlet.

The accompanying drawings show embodiments of the apparatus according to the present invention, which are further described in greater detail with reference to the figures wherein:

FIG. 3 shows a horizontal steamer in a sectional view with a vertically aligned inlet duct;

FIG. 4 shows the inlet zone of a horizontal steamer with several traveling loops arranged in front of a horizontal section;

Figure 1:
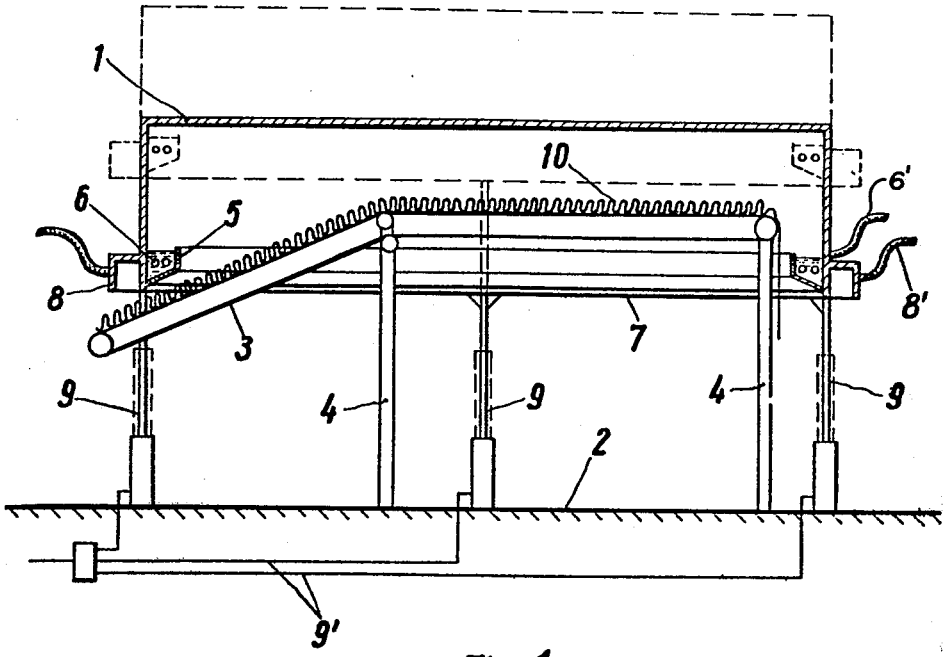
FIG. 1 shows a section through a steamer of this invention with a steamer hood which can be moved upwardly and downwardly with respect to a material conveying means.

Reference numeral 1 denotes a bell-shaped steamer hood, having an opening or open portion oriented toward the bottom 2. This opening not only makes the interior of the steamer accessible, but also contains a part of the conveying means 3 extending therethrough, which is supported on the floor by legs 4. The conveying means can consist of an endless conveyor belt, as illustrated, which first extends obliquely upwardly into the zone or interior of the steamer hood 1 and then runs horizontally through the steamer. The outlet can be arranged as illustrated, where the textile or man-made fiber material simply falls out of the steam atmosphere. However, it is also possible to extend the endless belt again obliquely downwardly at the outlet. It is furthermore contemplated to form the conveying device solely of an endless belt horizontally extending within the steamer, by which the material is drawn in vertically from below. Of course, there is also the possibility of disposing several conveying rollers in the zone of the ceiling of the steamer hood, over which rollers the material is guided in traveling loops. In any event, many different types of steamer construction may use the principles of this invention.

The steam atmosphere within the steamer hood 1 is produced with the aid of channels 5 open at the top, which are arranged around the opening in the hood in the zone or region of the steam level to be generated on the housing wall; these channels are traversed by pipes 6 through which flows superheated steam and are filled by water to produce the saturated steam. The saturated steam rising from these channels 5 fills the steamer hood 1 with steam until the lower level of steam has reached the lower edge 7 of the steamer hood. At that point, the additionally generated steam is exhausted into the surroundings or is positively conducted away (e.g. by a suction draft) from the steamer with the aid of intake means or steam removal means 8. An exact steam level can constantly be maintained especially with the aid of such intake means around the lower plane of the steamer hood. The feeding of the energy and of the water and the removal of the excess steam take place, due to the movability of the hood 1, via likewise movable, e.g. flexible, conduits, those for removing excess steam being designated by reference numeral 8'.

Figure 2:
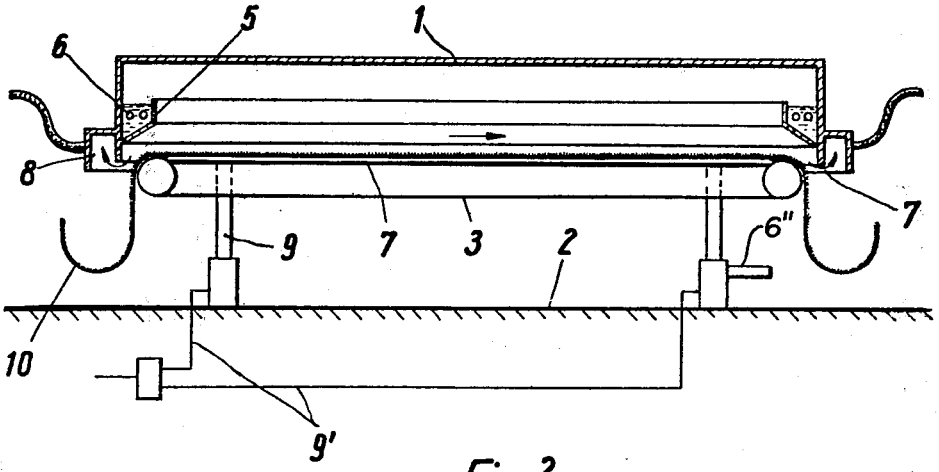
FIG. 2 shows a horizontal steamer in a sectional view.

If access must be attained to the conveying means or to the textile or man-made fiber material 10 of any desired type lying thereon, for some reason or another, the hood 1, in accordance with the construction shown in FIGS. 1 and 2, need merely be lifted into the postion (non-operating) shown in dashed lines with the aid of the telescopically extensible pistons 9 which support the hood 1 on the floor 2. As shown, the pistons are actuated by a fluid pressure medium via conduits 9'. With the lifting of the steamer hood, the steam bubble is also automatically lifted and thus remains intact unchanged for further use. After the operations within the zone of the original steam atmosphere have been completed, the pressure medium must be discharged via conduits 9', in order to place the apparatus back into operation, and thus the steamer hood is lowered into its original position, whereby the apparatus is at once ready for operation.

The printed material 10 shown in FIG. 2 to be fixed in the steam atmosphere enters the steam atmosphere from below at the inlet side and leaves the steam atmosphere in a downward direction on the outlet side as well. Furthermore, the steam level is produced at such a height and/or the steamer hood is arranged at such a height with respect to the conveying means 3 that the lower edge 7 of the steamer hood 1 is disposed shortly below the horizontally extending loaded face of the conveyor means, optionally also only shortly below the layer of material to be exposed to the steam. In this way, the printed layer of the length of material is exposed to the steam only when the material is conducted horizontally, which steam will condense on the material especially at the beginning of the fixation process. In this way, a bleeding of the printed contours is made impossible.

The adjustment of the steam level with respect to the material guided on a conveyor belt 3 is made possible, just as in the steamer of FIG. 1, in a simple manner by supporting the steamer hood on the floor 2. The support here again is provided by the pistons 9 which can be extended telescopically.

In the embodiment of FIGS. 2 and 3, a horizontally aligned conveyor belt 3 extends through the steamer hood, and in the arrangement of FIG. 4, several supporting rollers 3' are provided, disposed at right angles to the traveling direction of the material; the material 10 to be fixed, such as, for example a printed carpet, is carried through the steam bubble on these rollers.

The steam atmosphere within the steamer hood 1 of FIGS. 3 and 4 is produced with the aid of a water sump 11 (made up of a plurality of sump boxes) which extends only partially across the base or bottom open area of the hood. The sump boxes are supported from the sides and/or base of the housing. Air passage slots 12 are left vacant between the individual water sump boxes, through which the air, for example entrained with the material 10, can drop down due to its higher specific gravity. In addition to these water sump boxes 11, channels 5 open at the top are provided on the housing wall; these channels, just as the boxes 11, are traversed by pipes carrying superheated steam for the production of the saturated steam. Steam rises from these saturated steam producing means until the hood 1 is filled with steam and a level has been formed on the lower edge 7 of the steamer hood. The excess of the thus-produced steam — generally excess pressure is desirable in the steaming chamber — is forcibly removed by steam removing or collecting means including suction devices 8 in the direction of the illustrated arrows. Flexible conduits connected to these deivces are not shown. In this way, an exactly defined steam level can be produced and maintained constant.

In case of a material 10 which has poor gas permeability, an automatic removal of the air entrained on the pile side of the material is impossible in the horizontal section of the steamer. For treatment of such materials, the steamer of FIG. 3 is provided with a rather long vertical inlet duct 13 formed by the extended end wall 14 of the hood 1 and by a wall 15 arranged in parallel and spaced from this first-mentioned wall. Water sump boxes 16 for the production of the saturated steam in the inlet zone are arranged in this downwardly open, optionally also obliquely aligned duct 13. Several of these boxes 16 can be disposed one above the other. The lower edge of the inlet is surrounded by steam removal or collecting means 8, just as the remaining portion of the steamer.

The embodiment of FIG. 4 is modified as compared to FIG. 3 only insofar as several traveling loops 17 are provided in the inlet zone, for example, for dyed material. These loops are suspended over guide rollers 18 arranged in the zone of the ceiling of the hood. The traveling loops 17 are provided in the inlet zone 13 which is increased in height as compared to the horizontal section, so that the pooling of the applied dye at the beginning of the color fixation process is avoided.

If the inlet zone 13 is not to be filled with steam to prevent a running of the dye in the heating-up section, this zone can also be separated from the remaining part of the steamer by means of a wall 19. In this way, differing temperatures can be produced in the inlet zone and in the other portion of the steamer.

The measures as individually described and illustrated are not only of special advantage in connection with a horizontal steamer. Any type of steamer is suitable, such as, for example, also a multipledeck steamer.

Figure 5:
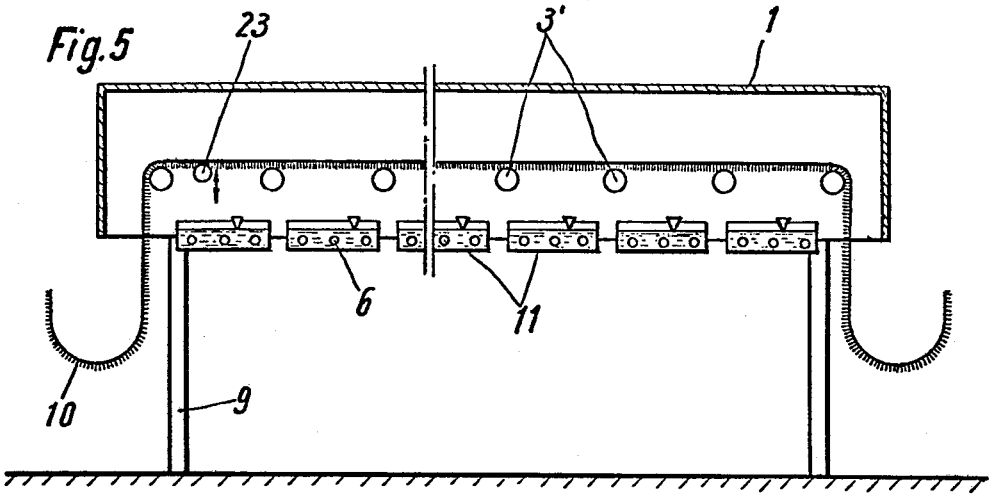
FIG. 5 shows a horizontal steamer similar to the embodiment of FIG. 3.
Figure 6:
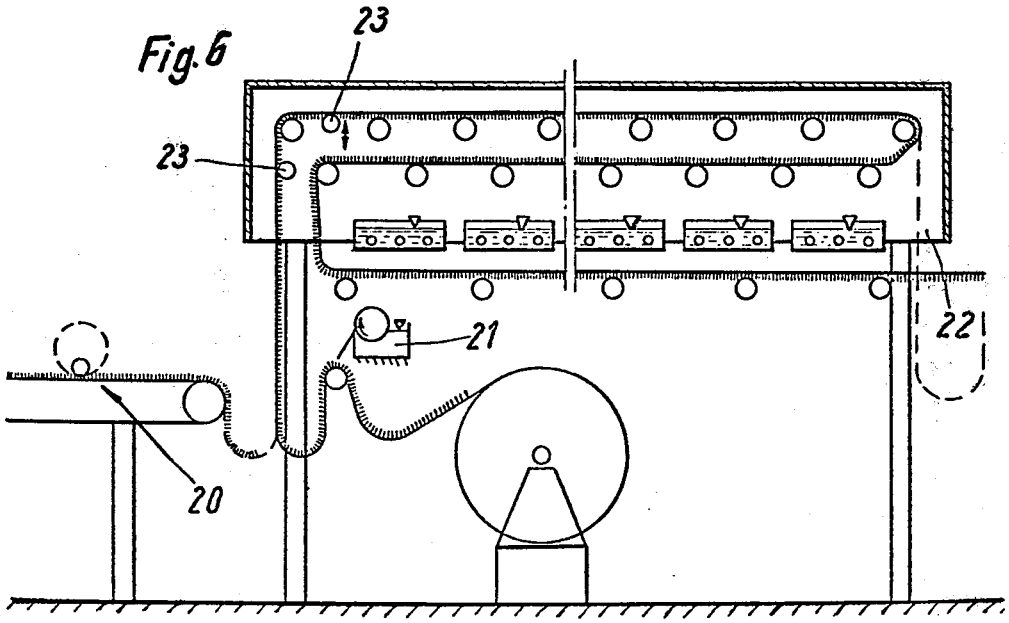
FIG. 6 shows the steamer of FIG. 5 with two different levels of the material to be treated.

In the embodiment of FIGS. 5 and 6, the material 10 travels into the steamer with the face or pile side pointing downwardly, as contrasted to the conveyance of the material customary in a planar steamer according to FIG. 2 or FIG. 3. Thus, the pile side of the carpet comes into contact with the conveying rollers 3'. A massage effect on the carpet pile with a more uniform dyeing result and a denser-appearing pile is the consequence thereof. This phenomenon holds true for the type of steamer shown in FIG. 5 as well as for the type shown in FIG. 6. Additionally, a certain result of the conveyance of the material with the pile side pointing downwardly as is a more uniform complete dyeing of the pile up to the pile tips, without the so-called grey veil. For this purpose, the material must in any event be transported, beyond the inlet, through the steamer with the face side in the downward direction. In the second deck of the type of steamer shown in FIG. 6, the pile can readily be pointing upwardly again, since the pile tips have been sufficiently dye-set after passing through the first steamer section.

In a continuous plant designed for carpet printing as well as solid-color dyeing, the planar steamer of the present invention can easily be utilized by arranging the printing device 20 in front of the steamer, while the dye applicator 21 operating according to the infusion principle is arranged below the steamer. If the material is to be imprinted, the pile, of course, points in the upward direction in order to be imprinted on the device 20. Likewise, the carpet travels through the planar steamer with the pile side pointing upwardly. If the material is dyed merely in a solid color, the material travels, in the embodiment of FIG. 6, from the right toward the left in the zone of the dye applicator 21, while it travels in the steamer first of all from the left toward the right, i.e. in the opposite direction. For a printed material, it is advantageous to utilize the steamer of FIG. 6 as a single-deck steamer; for this purpose, an outlet 22 is provided at the end of the steamer.

In addition to this special guidance of the material, a uniform fixation of the dye across the height of the pile is made possible by associating with the length of material 10 a roll 23 across the operating width, which roll vibrates in the direction toward the material. Thus, a complete saturation of the pile with the dye liquor and a secure fixation of the dye along the entire length of each fiber are ensured.

While the novel embodiments of the invention have been described, it will be understood that various omissions, modifications and changes in these embodiments may be made by one skilled in the art without departing from the spirit and scope of the invention.

What is claimed is:

1. An apparatus for the continuous steaming of textile material or man-made fiber material, endless material and also synthetic fibers which comprises at least one-bell shaped housing providing a treatment chamber closed all around by sidewalls and at least partly open at the bottom, means for supplying steam into said chamber and at least one conveying means for transporting the material so that said material extends from below into the housing and extends out of the housing again at the bottom thereof; said bell-shaped housing comprising a steamer hood that is arranged on support means above a mounting surface, said means for supplying steam comprising a saturated steam producing means including a water sump provided underneath the conveying means, said sump extending only partially across the width and length of the bottom of the hood and thus forming a plurality of air passages where the hood is open towards the bottom, and a material inlet passage extending downwardly with respect to a remaining portion of the housing, said inlet passage being defined by an outer end wall of the hood that extends in a downward direction and by an inner wall arranged in parallel and spaced therefrom, saturated steam producing means located within said inlet passage, and the housing being divided into two sections, with the inlet passage for the material being arranged in a first section, said at least one conveying means including at least two guide rollers for the conveyance of travelling loops having a certain length within the first section and a horizontal steamer arrangement being positioned in a second section.

2. The apparatus of claim 1, wherein the horizontal steamer arrangement is fashioned as a deck-type steamer, and an outlet is provided in the bottom of the traveling loop steamer section which is extended in the downward direction with respect to the deck-type steamer.

3. An apparatus for the continuous steaming of textile material or man-made fiber material in this material and synthetic fibers which comprises at least one bell-shaped housing providing a treatment chamber closed all around by sidewalls and at least partly opened at the bottom, means for supplying steam into said chamber, and at least one conveying means for transporting the material within the housing, so that the material extends from below and into the housing and extends out of the housing at the bottom thereof; said means for supplying steam into said chamber including water sump means extending along the bottom portion of said bell-shaped housing; said water sump means having a plurality of open containers spaced from each other to provide openings for removal of air from the textile material being treated within the steam housing, at least one of said containers defining a portion of an opening that forms an inlet passage for the material entering said housing and at least one other container defining a portion of an opening that forms an outlet passage for material exiting from said housing.

* * * * *